US005508712A

United States Patent [19]

Tom et al.

[11] Patent Number: 5,508,712

[45] Date of Patent: Apr. 16, 1996

[54] SELF-ALIGNING WAVE GUIDE INTERFACE

[75] Inventors: James C. Tom, Cupertino; Anthony W. Denning, San Martin; Kyong I. Dobson, Fairfield, all of Calif.

[73] Assignee: P-Com, Inc., Campbell, Calif.

[21] Appl. No.: 219,331

[22] Filed: Mar. 28, 1994

[51] Int. Cl.[6] ..... H01Q 1/22

[52] U.S. Cl. ..... 343/884; 343/878; 343/880; 343/840; 333/254

[58] Field of Search ..... 343/762, 839, 343/840, 878, 880, 882, 884; 333/248, 249, 254, 261; H01Q 1/22

[56] References Cited

U.S. PATENT DOCUMENTS

| | | | |
|---|---|---|---|
| 2,646,508 | 7/1953 | Fisher | 343/762 X |
| 2,667,578 | 1/1954 | Barnett et al. | 333/261 X |
| 2,955,288 | 10/1960 | Palmer | 343/878 X |
| 3,009,152 | 11/1961 | Gregory et al. | 343/762 X |
| 4,041,496 | 8/1977 | Norris | 343/853 X |
| 4,765,400 | 8/1988 | Chu et al. | 361/385 X |
| 4,786,913 | 11/1988 | Barendregt et al. | 343/762 X |
| 4,868,578 | 9/1989 | Bruinsma et al. | 343/880 X |
| 4,879,534 | 11/1989 | Spinner | 333/254 X |
| 4,901,369 | 2/1990 | Momose et al. | 455/84 |

FOREIGN PATENT DOCUMENTS

| | | | |
|---|---|---|---|
| 0449037 | 6/1948 | Canada | 333/248 |

*Primary Examiner*—Donald T. Hajec
*Assistant Examiner*—Steven Wigmore
*Attorney, Agent, or Firm*—Skjerven, Morrill, MacPherson, Franklin & Friel; Thomas S. MacDonald

[57] ABSTRACT

A microwave guide interface extends between a rear surface of a microwave antenna reflector and a facing surface of a base plate. An interconnect member having a ball surface extends rearwardly from the rear of the reflector. A second interconnect member having a ball-receiving socket extends forwardly from a facing surface of the base plate. A spring clamp is attached to a periphery of the base plate and includes a yoke coacting with a strike hook on a circular rib or on separate lugs extending from the rear of the reflector for cinching up the socket into abutting contact with the mating ball surface. A peripheral O-ring extends between peripheral surfaces of the members allows tilting of the assembly such that assembly and alignment can be made over a fairly wide range of angular tolerances of the base plate and reflector. This is especially desirous since the base plate and electronic packages thereon are relatively heavy and unwieldy and normally must be attached, or reattached if a polarization change is needed, to a reflector adjustably fixed high on a tower or pole.

8 Claims, 3 Drawing Sheets

SELF-ALIGNING WAVE GUIDE INTERFACE

FIELD OF THE INVENTION

This invention pertains to microwave guides and antenna connections used with equipment for point-to-point transport of voice and data communications. Digital transmission signals are multiplexed and modulated to become an IF signal, sent by cable normally to an outdoor unit (ODU) including an antenna which microwave signals radiate from the antenna, propagate to the antenna of a remote terminal and then are down converted by the ODU thereat to IF signals which are demodulated and then demultiplexed into individual digital transmission signals. More particularly the invention is directed to a microwave guide and antenna interface.

BACKGROUND OF THE INVENTION

In the prior art the microwave guide basically comprising a microwave guide tube includes square flanges at each end of the tube. The flanges are apertured to receive connecting bolts. Complementary square flanges are provided on the parabolic antenna and on the antenna base plate and the microwave guard tube flanges placed in abutment between the antenna and base plate flanges and bolted thereto. It is difficult and time-consuming to align and mount these parts and to dismount and reattach them, particularly when a polarization change is required. "Polarization" as used herein means the positioning of a sealed wave guide joint to radiate microwaves either horizontally or vertically. The prior art connection permits connection in only two rotative positions such that it is difficult to properly align the antenna. Alignment is necessary so that the transmitting antenna is accurately facing the receiving antenna at a remote location of the order of 1–10 kilometers away. Further, the prior art mating flanges are a source of leak paths of RF radiation.

SUMMARY OF THE INVENTION

The ODU of the invention utilizes an antenna having a parabolic reflector and a base plate, one of which includes a ball element and the other of which contains a ball-receiving socket element. In a preferred embodiment the respective elements are cast integral with the reflector or base plate. The polarization of the antenna is determined by the orientation in which the ODU is mounted onto the antenna so as to have the communications link operate in either horizontal or vertical polarization. The ODU is attached to the antenna and is secured preferably by four snap-on spring latches. Closing of the latches "cinches up" and holds a formed ball and socket joint between the base plate and antenna reflector. The ball and socket joint is located at the central axis of the antenna and base plate. Bolts or turnbuckles are provided for adjusting and securing the antenna in an azimuth fine adjustment direction or in an elevation fine adjustment position, after the antenna has been initially course aligned visually with the remote antenna. The DC voltage output at the AGE (Automatic Gun Control) connector is an indication of the receive signal level and is used to monitor the fine adjustment by peaking the signal. In the preferred embodiment the base plate includes heat sink structure in the form of rearwardly disposed integral pins. The pins are for heat sinking purposes. The array of pins collectively provide a large surface area for the heat inside the unit and the wave guide assembly to be transferred to the and ambient environment on the outside of the ODU. The pins have the advantage over commonly use fins in that they allow the base plate and integral heat sink to be rotated without a change in cooling efficiency. Fins placed in a changed orientation actually block air flow.

The latches are spring latches which force the wave guide sections, more particularly the ball and socket elements, together. The ball-socket joint is held in tension in positive contact to hold the antenna reflector against and in the base plate. Feet or lugs are provided on the base plate to permit a predetermined amount of rocking action between the ball and socket to accommodate tolerances. The distal ends of the lugs initially and after cinching up of the clamp have a gap with the rear of the antenna reflector which allows for no relative movement of the ball and socket and thus no relative rocking movement or deflection of the reflector and base plate after clamping. The entire load and connection of the base plate and reflector is at the ball and socket joint as urged by the spring clamps.

The wave guide internal cross-section is rectangular but not square. Such configuration permits a user to merely rotate the base plate only in an amount of 90° to effect a polarization change. This is done after the spring latches have been released. As an aid to simple reassembly a directional arrow is cast into the base plate which will show an up arrow for vertical polarization or a facing sidewards arrow for horizontal polarization. After the spring latches have again been quickly attached by latching, the aforementioned bolts or turnbuckles are torqued to make the fine azimuth and elevation adjustments of the reflector. The present invention thus allows reorientation of the base plate to any of four positions unlike the two positions of the prior art interconnection. The invention compensates for up to about ±3° of canting in assembling the base plate and the antenna reflector together. This greatly facilitates the mounting operation which generally must performed on an installation pole attached at some height above a building rooftop or on a tower and involves rather weighty structures. The invention functions so as to minimize radiation leaks resulting in insertion losses caused by degradation of the signal to be radiated and in return losses, the latter meaning that RF energy which does not propagate out of the wave guide but is reflected back into the wave guide and back to the RF generator.

DETAILED DESCRIPTION

Figure 1:
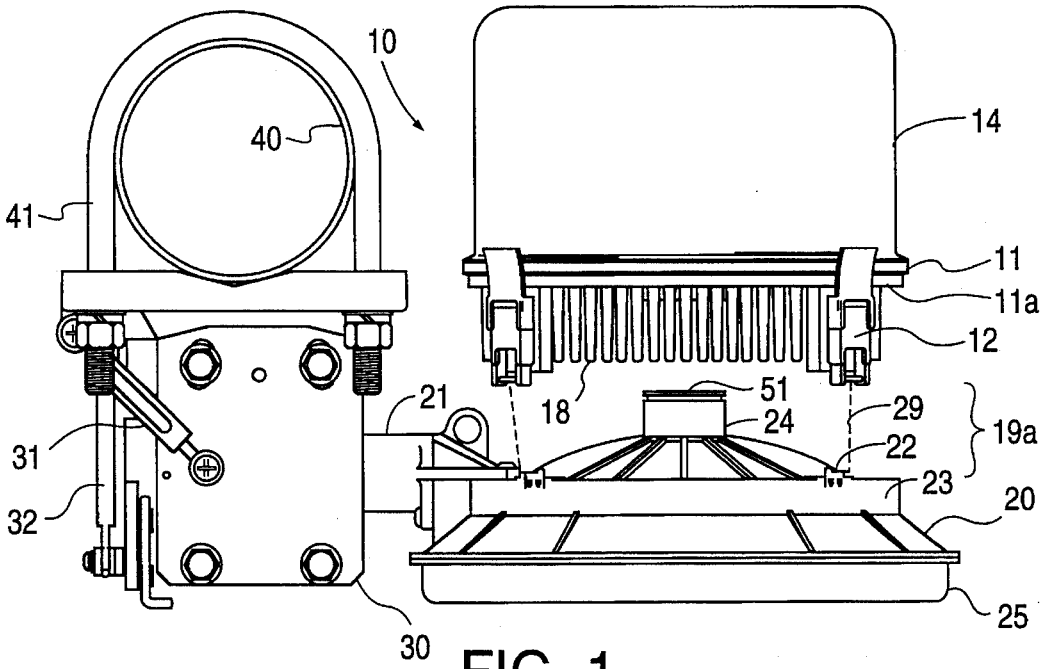
FIG. 1 is a top view of the overall pole-mounted outdoor unit with the base plate poised for mounting with the mounted antenna reflector.

The overall outdoor unit (ODU) 10 of the invention is seen in FIG. 1 where a base plate 11, antenna reflector 20 and an azimuth/elevation adjustment mechanism 30 including turnbuckles 31 and 32 is mounted to a vertical mounting pole 40 by a suitable U-clamp 41. The base plate 11 has a back surface onto which various electronic packages (not shown) are affixed. These include a transmitter, a receiver, and a microprocessor control unit. The back surface and the attached electronic packages are covered by a sealed cover 14 generally constructed of aluminum. Likewise, the front parabolic face of the antenna reflector 20 is sealed and protected by a cover 25 preferably of plastic material such as a closed cell polyvinylchloride which allows transmission of microwave energy therethrough. As shown by the dashed lines 29 the base plate and cover are moved toward and are attachable to the antenna reflector by spring clamps 12, normally four in number spaced 90° apart. Lever-operated compression spring catches Model No. HC 83314-42 available from Nielsen Hardware of Hartford, CT, may be employed. These include a yoke-bar which coacts with a strike hook 22 fastened to circular longitudinal rib 23 extending from the rear of the reflector to clamp and cinch-up the base plate with respect to the reflector 20. The reflector is connected to the azimuth and elevation adjusting unit 30 by pipe stub 21. A central ball having a weatherproof housing 24 extends rearwardly from the rear of the reflector 20 and includes a ball-containing ring 51 extending therefrom.

Figure 2:
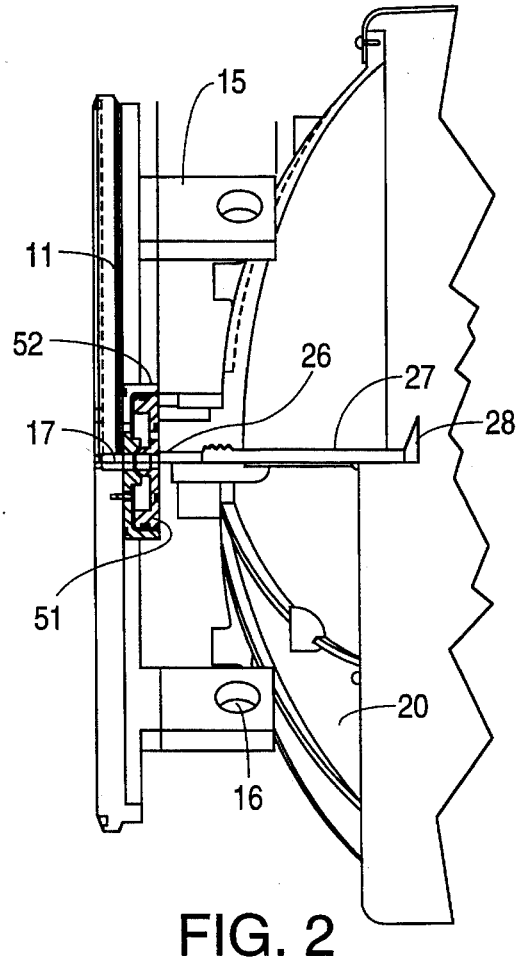
FIG. 2 is a side view of the base plate-antenna reflector interface with the ball and socket connection in cross-section.
Figure 3:
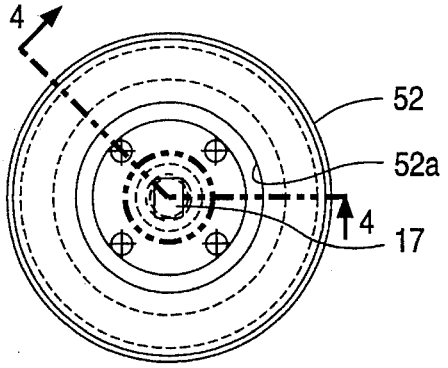
FIG. 3 is a rear view of the central area of the base plate.

As seen in FIG. 2 upon the spring clamping of base plate 11 to the reflector 20 the ball-containing surface member or ring 51 is mated with a central member or cup 52 containing a socket, the cup being attached to or integral with the base plate 11. Plate 11 also contains lugs 15 which after assembly clamping have a gap with the rear antenna reflector. As seen in more detail in FIG. 9, as the clamping commences, there will be a slight gap 56 between the ball surface and the socket surface. As the clamp is placed in a fully spring clamping position, the gap 56 is closed and the two surfaces are brought into abutting contact. The two surfaces are self-aligning such that the longitudinal axis 58 of member 52 is the same as the longitudinal axis 57 of member 51 after clamping. The close abutting contact aids in preventing radiation leakage of RF energy through the joint. Both the ball-containing ring 51 and the socket cup 52 include a central aperture (FIG. 3) through which a wave guide 17 passes. The wave guide further includes a wave guide tube 26, a wave guide extension 27 and a sub-reflector 28 for reflecting the RF energy to the parabolic surface on the inside of the reflector 20, which forms a collimated beam exiting the antenna.

Figure 4:
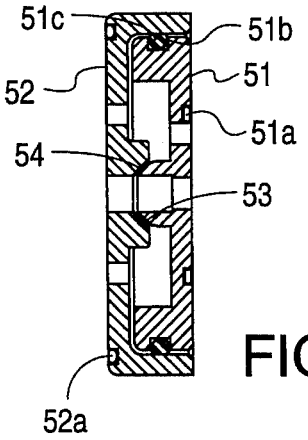
FIG. 4 is a cross-sectional view taken on the line 4—4 of FIG. 3.

FIG. 4 shows the interconnection between ring 51 and socket cup 52 where a ball portion 53 mates with a socket portion 54, respectively. Ring 51 has a U-shaped cross-section with an upstanding peripheral portion forming the legs of the U- and the ball portion extending from a central portion of the U-base. O-ring **51*c* is provided in groove 51*b*. The O-ring 51*c* upon spring clamping maintains a watertight seal for the wave guide. O-ring 51*a* and 52*a* on the ring 51 and cup 52, respectively, and O-rings (not shown) are used to seal the ring and cup to the base plate 11 and antenna 20** when the ring and cup are not integral therewith.

Figure 5:
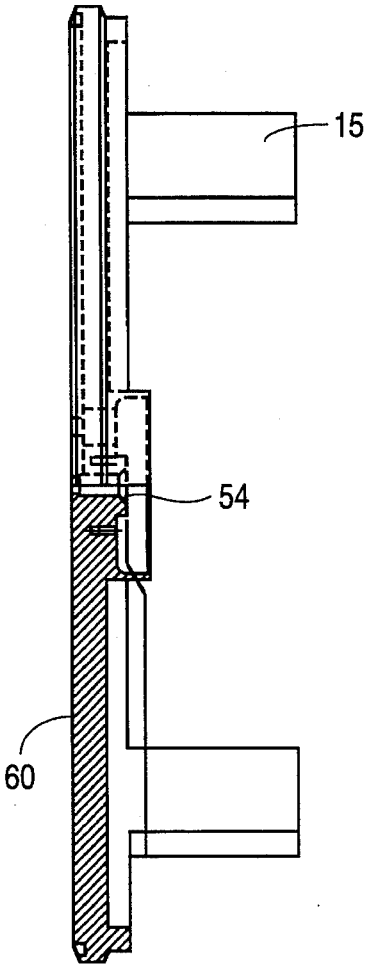
FIG. 5 is a side view of the base plate partially in cross-section.

FIG. 5 illustrates a base plate 60 (with the heat rejection pins not shown for reasons of clarity) where the socket portion 54 is integral with the base plate.

Figure 7:
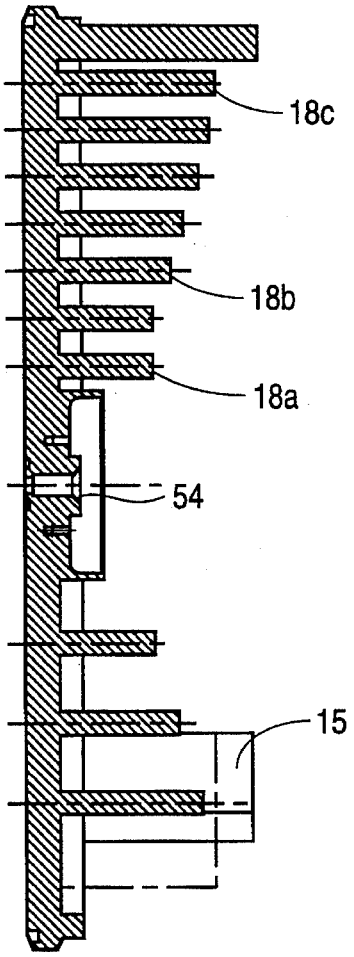
FIG. 7 is a cross-sectional view of the base plate of FIG. 6 showing the heat sink pins and the base plate lugs.
Figure 6:
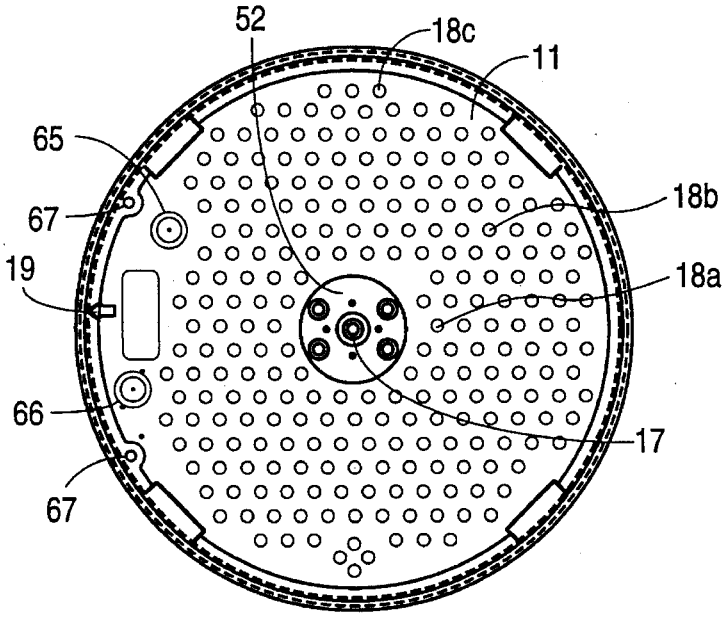
FIG. 6 is a front view of a heat sink-containing base plate.

FIGS. 6 and 7 illustrate in detail the heat sink configuration shown in FIG. 1. An array of heat sink pins 18 have distal ends **18*a*, 18*b* and 18*c* which are of varying heights so as to generally follow but spaced from the rear parabolic contour of the reflector. Short pins 18*a* are provided juxtaposed to the central hub forming the socket cup 52 while longer pins 18*c* are juxtaposed to the base plate periphery. Pins 18*b* of various intermediate heights are also provided. Collectively, the pins have a large surface area for heat radiation and can operate with equal efficiency in any 90° orientation of the base plate and the reflector. The entire periphery and distal ends of pin 18 are visually exposed to ambient in the clamped position of the base plate and the reflector, more particularly in an open about 5 cm wide annulus 19*a* between the top of circular rib 23 and the bottom 11*a* of the base plate from which the pins 18** depend.

The desired radiating area A in square inches of the outside surfaces of the array of pins is calculated by the formula $$\Delta T^{\circ}C. = 300 \times \frac{P}{A}$$

where ΔT is the difference between the operating temperature of the central wave guide assembly and an average ambient temperature and P represent power in watts. For example, A can be calculated given a ΔT of 20° C. and a P value of 37 watts.

The bottom surface of the base plate includes an embossed cast direction arrow 19 which shows a horizontal polarization position. If a vertical polarization position is desired the base plate is rotated 90° either clockwise or counter-clockwise so that the arrow 19 faces upwardly or downwardly, respectively. A cable connector port 65, a AGC monitor port 66 and earthing screw holes 67 are included on the base plate.

Figure 8:
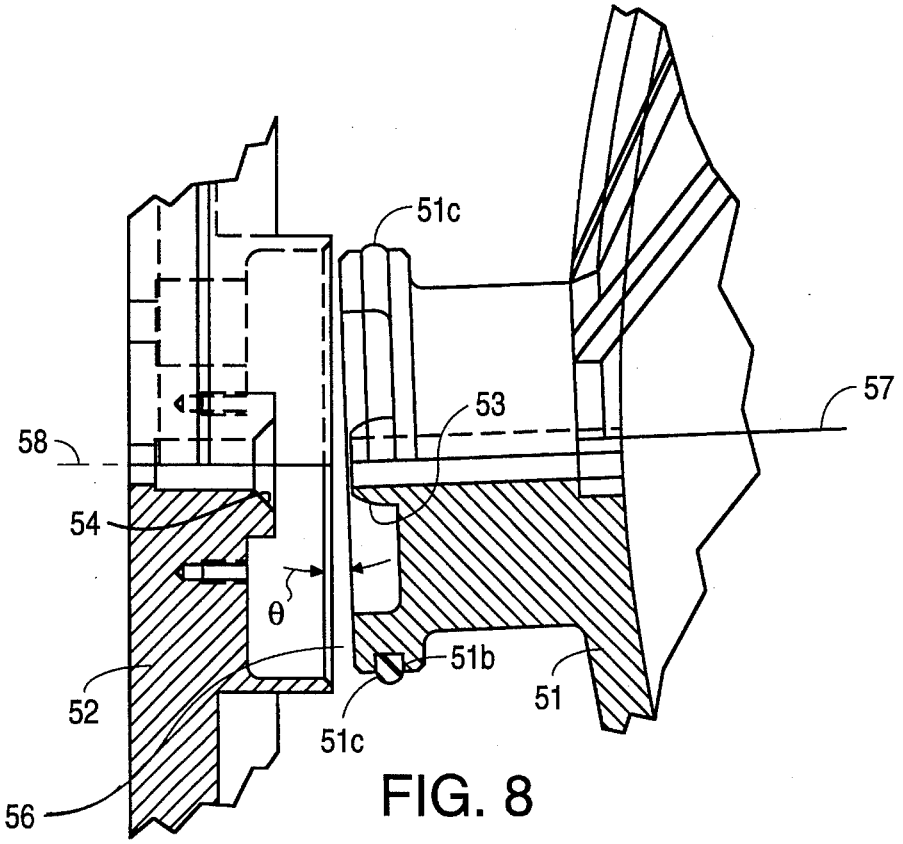
FIG. 8 is a detailed side view partially in section of an articulated ball and socket interconnection per se of the base plate and antenna reflector prior to mating.
Figure 9:
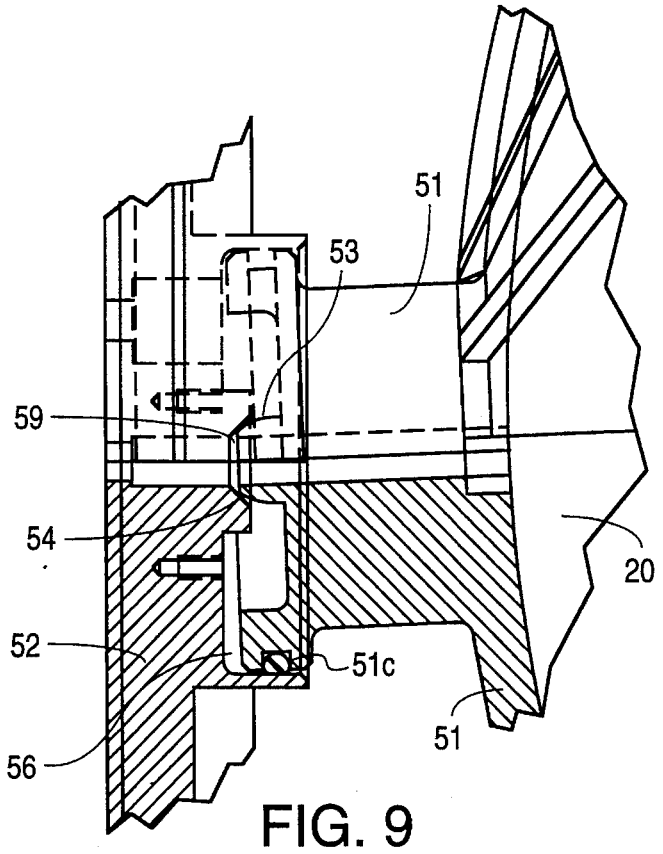
FIG. 9 is a detailed side view partially in section with the members mated but not yet seated.

FIGS. 8 and 9 illustrate the ability of the ball portion 53 and socket portion 54 combination to universally rock or tilt while enabling the base plate and reflector to which they are attached or integral with, to be easily aligned as shown in FIG. 8 and then be placed into an initial mating position (FIG. 9) and with completion of the spring clamping clamped into aligned abutment with each other. The rock angle may be from about −3° to about +3° or more which allows the base plate and reflector to be easily put together or mated despite considerable initial misalignment θ of the longitudinal axes 57 and 58 of each. The construction affords a wide tolerance in assembly of the base plate to the reflector. The ball may also have the freedom to move 360° in rotation with respect to the socket. "Ball" or "ball surface" as used herein includes any spherical, semi-spherical or other curved or conical surface where that surface and a mating surface of the socket can be rocked or tilted with respect to one another. Preferably the relative curvatures should be slightly different so as to ensure initial mating of the ball surface and the socket surface right at the edge 59 of the wave guide opening which extends through the ball and through the socket so as to avoid any leak gap at that location.

The reflector may be made from 356 aluminum heat treated to a T-51 condition and covered with a gold-color film, in accord with MIL-C-5541 Class 3. The heat sink base plate casting can be made from the same material and covering. Threaded holes in the reflector and base plate are painted using Sherwin Williams Grey Polane H.S. Plus Rex No. F63-JXA 6385-8127 paint and Morton Coating Polyester Utility Grey #20-7025 paint, respectively.

The reflector can be elevated in elevation preferably about ±20° coarse and ±10° fine and in azimuth from about ±180° coarse and ±10° fine. Antenna diameters including 300 mm and 600 mm are contemplated with beam widths of 1.6° and 0.8° respectively. The ball ring and socket cup in FIG. 4 may be made of 6061-T6 aluminum alloy with a clear chemical coating per MIL-C-554 Class 3.

The above description of embodiments of this invention is intended to be illustrative and not limiting. Other embodiments of this invention will be obvious to those skilled in the art in view of the above disclosure.

We claim:

1. A wave guide interface comprising:

a first wave guide member;

a second wave guide member adapted to mate with said first wave guide member; and wherein each of said wave guide members includes a central aperture forming a wave guide, one of the wave guide members having a spherical ball surface surrounding the central aperture of said one of the wave guide members and the other of said wave guide members having a frustra-conical socket surface surrounding the central aperture of said other of the wave guide members, such that upon mating and clamping, the wave guide members abut each other at an edge of said central apertures to avoid an RF energy leak path.

2. The interface of claim 1 further including an O-ring extending between mating peripheral edges of said wave guide members.

3. The interface of claim 1 wherein said first and second wave guide members are connected respectively to the rear face of an antenna reflector and to a base plate.

4. The interface of claim 3 wherein the wave guide members are integral with their respective antenna reflector and base plate.

5. The interface of claim 1 in which said wave guide members are tiltable over about a ±3° tilt and are self-aligning when mating and clamping into a common longitudinal axis.

6. The interface of claim 1 wherein one of said wave guide members has a U-shaped cross-section including an annular projection having said spherical ball surface formed on a distal end thereof and the other of said wave guide members has a U-shaped cross-section including an annular projection having said conical surface socket formed thereon, said wave guide members having peripheral mating edges separated by an O-ring extending from a peripheral circular groove in one of said peripheral mating edges, relative movement of said wave guide members causing a sliding of a surface of said O-ring exterior of said circular groove against an opposed surface of the other peripheral mating edge.

7. The interface of claim 3 further comprising clamping means on said base plate and said antenna reflector for clamping said base plate and said reflector together such that the first and second wave guide members are cinched up into mating assembly.

8. The interface of claim 7 wherein said clamping means comprises a spring clamp on said base plate and a strike hook on said antenna reflector.

* * * * *